United States Patent [19]

Janson et al.

[11] 4,262,430

[45] Apr. 21, 1981

[54] COMBINATION SOLVENT RECLAIMER AND DRYER

[75] Inventors: Harry W. Janson, Fairhaven; Jung W. Kim, Westport; Richard R. Manzone, Fairhaven, all of Mass.

[73] Assignee: Hoyt Manufacturing Corporation, Westport, Mass.

[21] Appl. No.: 94,563

[22] Filed: Nov. 15, 1979

[51] Int. Cl.[3] ..... F26B 21/06

[52] U.S. Cl. ..... 34/43; 34/54; 34/77; 34/133; 68/18 C; 68/209

[58] Field of Search ..... 68/18 C, 18 R, 209; 34/77, 43, 133, 54, 50, 23, 27, 32

[56] References Cited

U.S. PATENT DOCUMENTS

| | | | |
|---|---|---|---|
| 1,654,836 | 1/1928 | Schlesinger | 68/209 |
| 1,914,616 | 6/1933 | Power | 68/209 |
| 1,981,234 | 11/1934 | Hetzer | 34/77 |
| 2,910,783 | 11/1959 | Hoyt | 34/133 |
| 3,019,003 | 1/1962 | Glitsch | 137/534 |
| 3,190,011 | 6/1965 | Shields | 34/77 |
| 3,807,948 | 4/1974 | Moore | 68/18 C |
| 4,154,002 | 5/1979 | Moore | 34/77 |

*Primary Examiner*—Larry I. Schwartz

[57] ABSTRACT

A solvent reclaiming dryer having an endless duct system including an evaporating chamber, fan, heater, condenser and condenser bypass duct in its circuit and having means to alternately pass heated solvent-laden gas through the condenser and through the bypass duct to increase the vapor pressure of the solvent that is passing through the condenser, thereby increasing solvent reclamation efficiency. Also shown are an explosion hatch and an automatic fire extinguishing system for use in tumblers evaporating inflammable solvents.

16 Claims, 7 Drawing Figures

PREHEAT CYCLE I
RECLAIM CYCLE –
RESATURATION MODE III

RECLAIM CYCLE–
CONDENSATION MODE II

COOL DOWN CYCLE IV

DEODORIZE CYCLE V

COMBINATION SOLVENT RECLAIMER AND DRYER

BACKGROUND OF THE INVENTION

This invention relates to solvent reclaiming drying tumblers used in the drycleaning industry.

There are presently two major types of solvent employed in drycleaning—perchloroethylene, which is expensive, non-inflammable, and easily recoverable, and petroleum solvent, which is relatively inexpensive, inflammable, and difficult to recover for having a low vapor pressure. Tumblers using petroleum solvent have heretofore generally been exhausted to the atmosphere; however, with both increasing cost for petroleum solvent and concern for air quality, it is desired to condense and reclaim the petroleum solvent evaporated from drycleaned clothes.

Drying tumblers for recovering easily recoverable perchloroethylene are known in the art. An example in U.S. Pat. No. 2,910,783, which shows a solvent reclaiming drying tumbler having an endless duct system including a basket, fan, heater, and condenser in its circuit so that a stream of heated solvent-laden air may be driven through the condenser. The tumbler also has a branch duct allowing bypassing of the condenser during both a preheating cycle, which occurs before, and a deodorizing cycle, which occurs after, a solvent reclaiming cycle wherein the solvent-laden air is passed through the condenser in which the solvent is condensed.

SUMMARY OF THE INVENTION

In general our invention features reclaiming solvent during a reclaiming cycle of a dryer by alternately (1) passing heated solvent-laden air through the condenser wherein the solvent vapor is liquified and collected and (2) increasing the saturation of said solvent vapor by blocking the entrance of said condenser and passing said solvent-laden gas through a bypass branch duct and thereafter recirculating said gas through the heater and evaporating chamber. In preferred embodiments the reclaiming cycle lasts between 20 and 40 minutes; the recurring passing step lasts between 55 and 65 seconds; the recurring increasing step lasts between 20 and 30 seconds; and an on-off time delay relay controls an air cylinder actuating air solenoid valve, which in turn causes the damper to be positioned to allow either the passing or increasing step. Efficient recovery of difficult-to-recover solvents having low vapor pressures is thus made possible.

In another aspect our invention features covered safety openings in the casing, the covers being responsive to increased pressures caused by an explosion within the casing to allow release thereof. In preferred embodiments one cover is pivotally mounted and gravity biased into a closed position, and other covers are also gravity biased and mounted upon shafts within sleeves for limited movement along an axis perpendicular to the openings. The structural integrity of the apparatus is thereby protected in the event of an explosion of inflammable solvents therein.

In another aspect our invention features a conduit for passage of fire suppressing fluid to the casing and a valve associated with the conduit that opens in response to sensors sensing the occurrence of predetermined fire related conditions. In preferred embodiments one sensor is a fusible link suspended within the casing that melts and causes the dropping of a weight attached to an activating lever of the valve, and another sensor is an explosion hatch that covers an opening in the casing and is mounted on a rotatable shaft having a weight supporting hook, the rotation of the shaft causing the dropping of another activating weight in the event of an explosion.

DESCRIPTION OF PREFERRED EMBODIMENT

We turn now to the structure and operation of a preferred embodiment of the invention, after first briefly describing the drawings.

Drawings

STRUCTURE AND OPERATION

Figure 1:
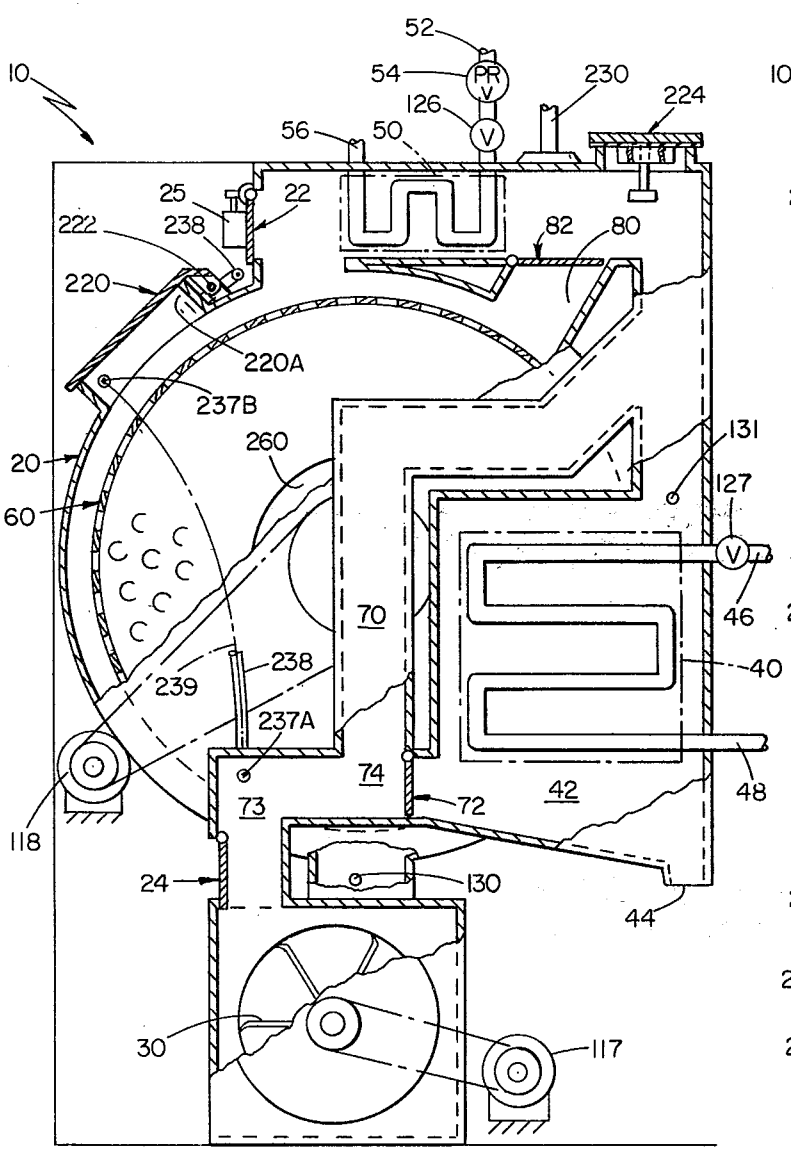
FIG. 1 is a somewhat schematic and partly broken away rear elevational view of a solvent reclaiming drying apparatus of the invention.

Referring to FIG. 1, within solvent reclaiming drying apparatus 10 is shown casing 20, which encloses an endless duct system including fan 30, condenser coil 40, heating coil 50, perforated basket 60, condenser bypass duct 70, and heating coil bypass duct 80. Fan 30 and basket 60 are driven by three phase motors 117 and 118, respectively. Condenser coil 40 is located within reclaiming chamber 42, which has solvent condensate outlet 44, and is cooled by cold water entering port 46 and leaving via port 48. Heating coil 50 is heated by steam transported to it in pipe 52 and leaving via port 56, the steam flow being controlled by steam solenoid valve 126 and the steam pressure being maintained at 80 psig by pressure regulator 54.

There are four dampers for controlling airflow to and within the endless duct system: intake damper 22, which normally closes an opening to the atmosphere immediately upstream of the perforated basket 60; air exhaust damper 24, also closing an opening to the atmosphere and being pivotally mounted to divert all air driven by fan 30 when opened; condenser bypass damper 72, which is pivotally mounted at branch 74 downstream of fan 30; and heater bypass damper 82, which is pivotally mounted in ductwork coming from condenser chamber 42 and bypass 70. All dampers are controlled by spring-returned air cylinders (cylinder 25 for damper 22 in FIGS. 1 and 2 is the only one shown), which each hold its associated damper in one position when activated, and in another position when deactivated and spring returned.

Figure 2:
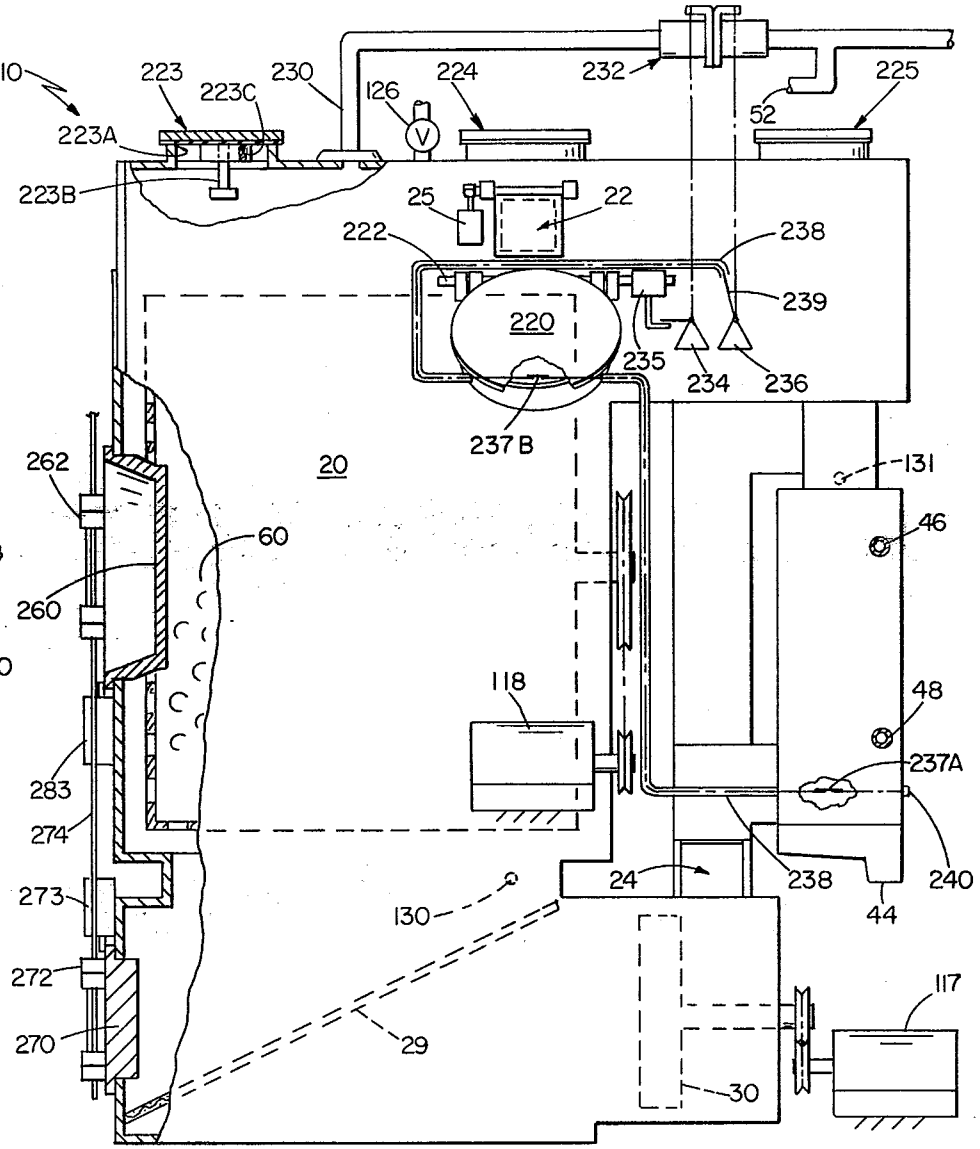
FIG. 2 is a somewhat schematic and partly broken away side elevational view of the apparatus of FIG. 1.

FIG. 2 shows explosion hatch 220 and blow-out plates 223, 224, 225, which provide vapor-tight closures for openings communicating with the endless duct system and allow for quick release of gases in the event of an explosion of inflammable petroleum solvent. Hatch 220 covers opening 220A and is mounted on pivotable bar 222, and plates 223, 224, 225 are movably mounted for limited vertical movement. The blow-out plate mounting is shown for plate 223 and comprises a bar 223B slidably mounted on spider-supported sleeve 223C centrally positioned in opening 223A. After any explosive forces are dissipated, hatch 220 and plates 223, 224, 225 close their respective openings by gravity.

There also is an automatic fire extinguishing steam injection system having steam pipe 230 communicating with the inside of casing 20 and being controlled by valve 232, which is actuated by the falling of either or both of weights 234, 236. Weight 234 is supported by hook 235 mounted on bar 222 and falls upon rotation of bar 222 caused by opening of explosion hatch 220. Weight 236 is supported by steel cable 239, which passes through tubing 238 and has fusible links 237A and 238B located in the hatch cover opening 220A and fan outlet duct 73, respectively. Fuse links 237A, 237B melt when they reach 350° F., a temperature reached during fire and/or explosion, thereby dropping weight 236 and opening valve 232. Also shown in FIG. 2 is lint filter 29 located immediately upstream of fan 30.

By referring to FIGS. 3 through 6, one can understand the damper operation which provides the various airflow circuits.

Figure 3:
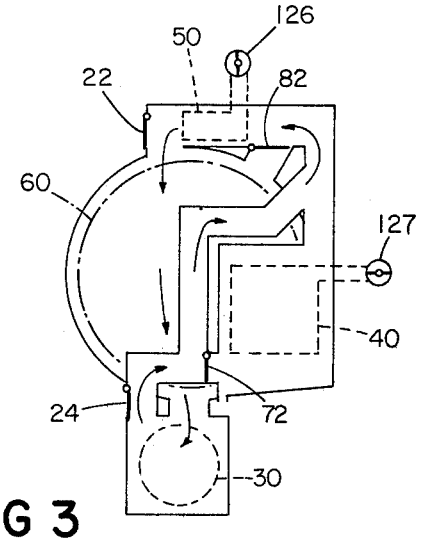
FIG. 3 is a diagrammatical view similar to FIG. 1 showing the parts in as position to provide both a Preheat Cycle I and a Resaturation Mode III of the Reclaim Cycle.

FIG. 3 shows the opening positions for steam and water control valves 126, 127, respectively, and condenser bypass damper 72 and the closed positions for air intake, air exhaust and heater bypass dampers 22, 24, 82, respectively, during the preheat cycle, which lasts 25 seconds.

The reclaim cycle, which can last up to 60 minutes depending on the timer setting, includes the alternately repeating condensation mode (FIG. 4) and resaturation mode (also shown in FIG. 3). Throughout this cycle, condenser cooling-water-line solenoid valve 127 is responsive to temperature control 131 (Robertshaw-Fulton Controls Co.—Model KXR10-36) located immediately upstream of condenser 40, the contacts of which break upon the temperature of air leaving the condenser chamber 42 dropping below the 90° F. suggested control setting, resulting in the interruption of the condenser water supply to preclude further cooling, and vice versa, thus maintaining the temperature of the air leaving the condenser coil at the control setting. Also throughout the reclaim cycle, heater bypass damper 82 is responsive to temperature control 130 (Robertshaw-Fulton Controls Co.—Model K99-120) located immediately upstream of the fan 30, the contacts of which break upon temperature rise, resulting in the air flow bypassing the heater coil to preclude further heating, and vice versa, thus maintaining the temperature within the machine at the control temperature setting, which is selected to be high enough to provide sufficient solvent evaporation but low enough to avoid damaging the fabric or machine parts.

Figure 4:
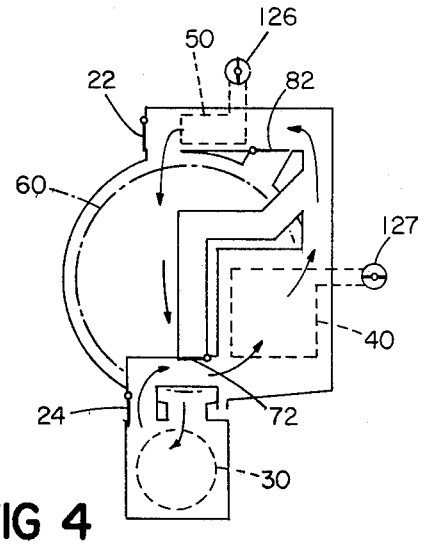
FIG. 4 is a diagrammatical view similar to FIG. 1 showing the parts in a position to provide Condensation Mode II of the Reclaim Cycle.

FIG. 4 shows the 60 second long condensation mode wherein highly saturated air is passed over condensing coil 40, thereby being efficiently condensed and collected at the solvent condensate outlet 44. The damper and valve positions in this mode are identical to those in the preheat cycle shown in FIG. 3, except condenser bypass damper 72 is closed thereby directing air through the condenser 40.

In the resaturation mode solvent vapor pressure is increased by bypassing condenser 40 and recirculating the air through heating coil 50 and basket 60 for a 25 second period. In this mode the valve and damper positions are as shown in FIG. 3 with heater bypass damper 82 being responsive to temperature control 130.

It has been found that the condensation mode should be at least 15 seconds long to achieve significant condensation, and that increasing the resaturation mode beyond 60 seconds results in activating temperature control 130 and opening heater bypass damper 82, thereby causing only insignificant increases in the solvent vapor pressure. To achieve the best results, the condensation and resaturation modes' time periods are kept within 5 seconds of the preferred 60 and 25 seconds values, respectively.

Figure 5:
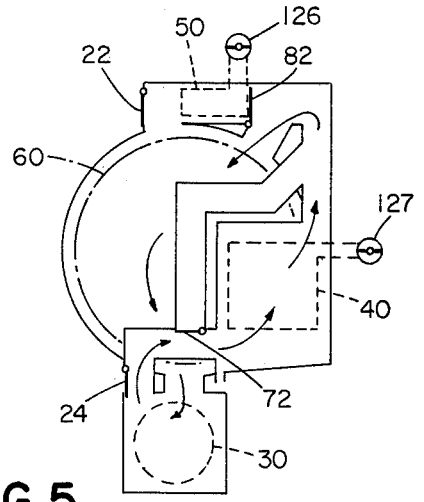
FIG. 5 is a diagrammatical view similar to FIG. 1 showing the parts in a position to provide a Cool-Down Cycle IV.

FIG. 5 shows the cool-down cycle, which can last up to 10 minutes, depending on the timer setting, and starts after the reclamation cycle is finished. Here, steam solenoid valve 126 and condenser bypass damper 72 are closed and water supply solenoid valve 127 and heater bypass damper 82 are maintained open, thereby providing optimum cooling-down of the apparatus 10 and its load of garments.

Figure 6:
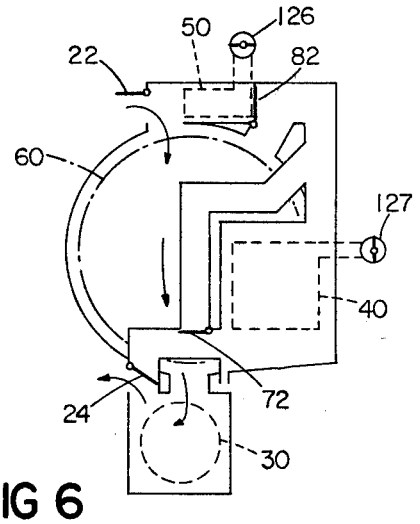
FIG. 6 is a diagrammatical view similar to FIG. 1 showing the parts in a position to provide a Deodorizing Cycle V.

FIG. 6 shows the deodorizing cycle wherein the air intake and exhaust dampers 22, 24, respectively, are opened thereby creating an open path wherein fresh air is passed through the basket 60. The other valves and dampers are in the same positions as the cool-down cycle except that water supply valve 127 is closed to conserve water.

Figure 7:
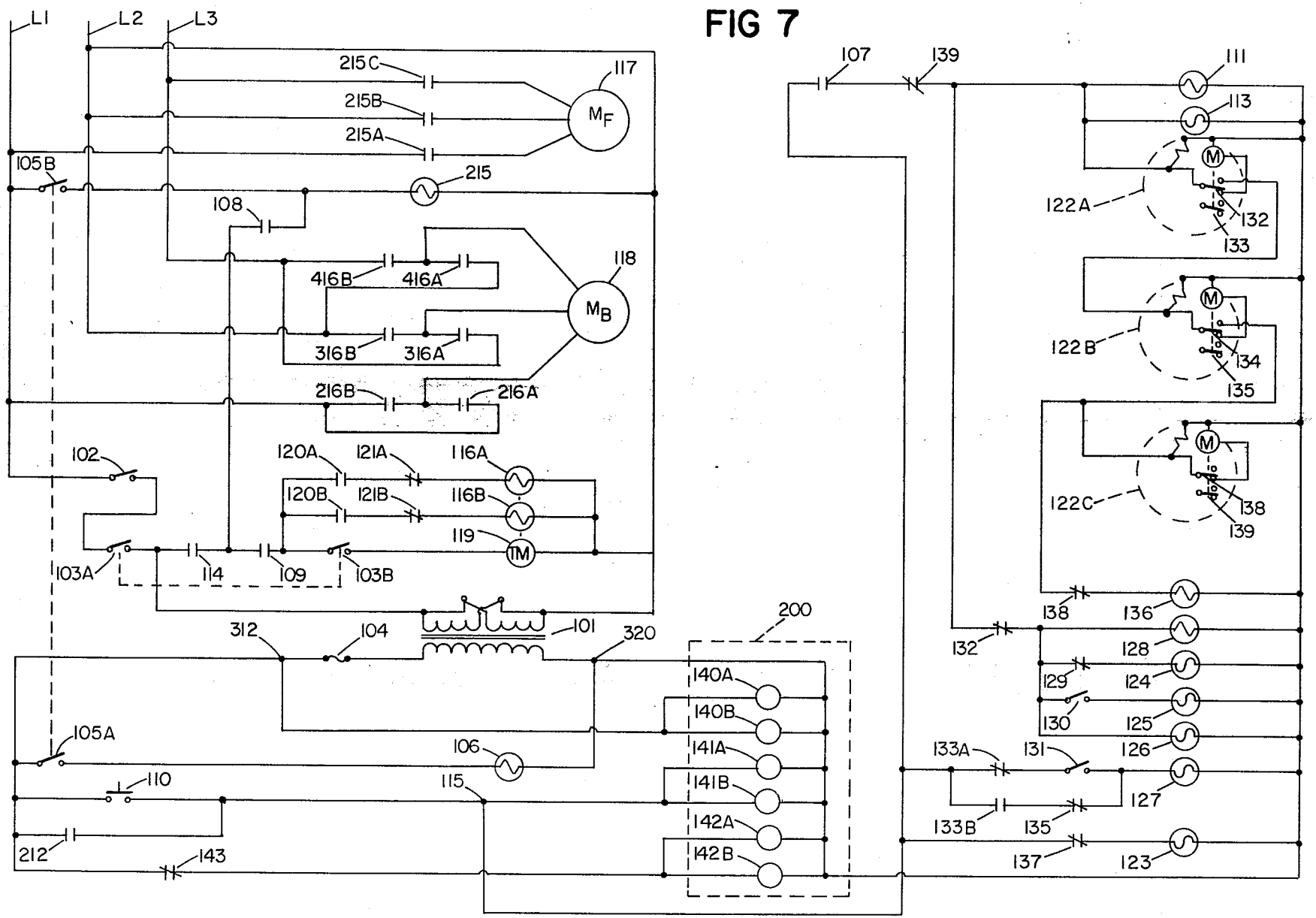
FIG. 7 is a circuit diagram for providing the control means of the invention.

As is shown in FIG. 7, fan motor 117 and basket drive motors 118 are powered by 230 volt/60 hertz/3 phase power, which is brought to the line terminals of the three-pole contactors by lines L1, L2, and L3. 230 volt/60 hertz/1 phase power is also brought over lines L1 and L2 to the primary winding connections of step-down transformer 101 (General Electric—Model 9B58B45) through switches 102 (on remote control panel) and 103A (on machine and integral with switch 103B). All other controls are 115 volts/60 hertz and are supplied by the secondary winding of the transformer over lines 320 and 312, through fuse 104.

To make drying apparatus 10 operative, both its loading door 260 and lint filter door 270 must be closed causing the normally-open contacts 105A of pneumatically-operated serially-connected (by line 274) door switches 272, 262 to close, thereby energizing door switch relay 106, and causing its normally-open contacts 107, 108, and 109 to close. To initiate operation, control switch 110 is depressed to energize holding relay 111, allowing power to be supplied by line 115, through relay contacts 212 and the already-closed relay contacts 107. Simultaneously, door interlock air solenoid valve 113 is energized, actuating interlock cylinders 283, 273 for the loading and filter doors respectively, thereby preventing either door from being opened. Also simultaneously, relay contacts 114 close, energizing fan motor contacter 215 and associated normally-open contacts 215A, 215B, 215C, through the already-closed relay contacts 108 and also energizing basket drive motor reversing contactors 116A, 116B through the already-closed relay contacts 109, causing fan motor 117 and basket drive motor 118 to start. Switch 103B is a three-way selector switch, which when closed, energizes reverser timer motor 119, causing reversing contactor coils 116A (and associated contacts 216A, 316A, 416A) and 116B (and associated contacts 216B, 316B, 416B) to be energized alternately, through reverser cam switches 120A and 120B, and reversing contactor interlock switches 121A and 121B, which safeguard against both coils being energized simultaneously. Reverser timer motor 119 drives a cam at 1 R.P.M., resulting in the basket drive motor 118 direction of rotation being reversed every 30 seconds.

The operating mode is rendered automatic by means of automatic reset timers 122A, 122B, and 122C (Gulf & Western Mfg. Co.—Eagle Controls Division—Models BR410A600 and BR408600, and BR407600, respectively). Energization of line 115 starts the preheat and reclaim timer 122-A, and simultaneously activates: air intake and exhaust air cylinder actuating air solenoid valve 123, causing the air intake and exhaust dampers 22, 24, respectively, to close; condenser bypass air cylinder actuating air solenoid valve 124, causing the condenser bypass damper 72 to open; heater bypass air cylinder actuating air solenoid valve 125, causing the heater bypass damper 82 to close; steam solenoid valve 126; and condenser water solenoid valve 127. This puts the machine 10 in the initial preheat cycle of operation.

Condenser bypass air solenoid valve 124 is responsive to variable time delay relay 128 (Omnetrics, Inc.—No. FDR115A2Y360A360), which is set for its contacts 129 to be initially closed for 25 seconds (the preheat cycle), and thence alternately open for 60 seconds (the condensation mode of the reclaim cycle) and closed for 25 seconds (the resaturation mode of the reclaim cycle).

Upon reclaim cycle timer 122A timing out, the normally-closed contacts of its switch 132 open, stopping the timer motor and de-energizing time delay relay 128, condenser bypass air solenoid 124, heater bypass air solenoid valve 125 and steam solenoid valve 126, thereby terminating the reclaim cycle. Simultaneously, the normally-closed contacts of its switch 133A open and the normally-open contacts 133B close, electrically bypassing temperature control 131 to continuously energize water solenoid valve 127, and the normally-open contacts of its switch 132 close, energizing cool-down cycle timer 122B, thus putting the machine in the cool-down cycle of operation.

Upon cool-down cycle timer 122B timing out, the normally-closed contacts of its switch 134 open, stopping the timer motor, and the normally-closed contacts of its switch 135 open, de-energizing water solenoid valve 127, thereby terminating the cool-down cycle. Simultaneously, the normally-open contacts of switch 134 close, energizing deodorize cycle timer 122C and intake/exhaust relay 136, causing its normally-closed contacts 137 to open and de-energize air intake and exhaust air solenoid valve 123, thus putting the machine in the deodorize cycle of operation.

Upon deodorize cycle timer 122C timing out, the normally-closed contacts of its switch 138 open, stopping the timer motor and de-energizing intake/exhaust relay 136, causing its normally-closed contacts 137 to close and energize air intake and exhaust air solenoid 123 thereby terminating the deodorize cycle. Simultaneously, the normally-closed contacts of its switch 139 open, interrupting the circuit to holding relay 111, causing it to drop out and allow its contacts 212 and 114 to open, de-energizing line 115, fan contactor 215 and basket motor contactors 116A, 116B, thereby deactivating all controls and both motors, thus terminating the automatic cycle of operation, and releasing the door interlocks to permit opening the door 260 for unloading the machine.

Opening either the loading door 260 or lint filter door 270 actuates the door switch, causing its contacts 105A to open and its contacts 105B to close. Open contacts 105A de-energize door switch relay 106, causing its normally-open contacts 107, 108, and 109 to remain open. Open contacts 109 interrupt the power supply to basket drive motor 118 reversing contactors 116A, 116B thereby preventing basket cylinder 60 from rotating whenever the loading door 260 is open. Open contacts 107 interrupt the circuit to holding relay 111, thereby preventing the initiation of the automatic cycle of operation unless both doors 260, 270 are closed. Closed door switch contacts 105B bring power from L1 directly to fan contactor 215, causing the fan to operate whenever either door is open to draw air into the machine to prevent the escape of solvent fumes into the room. Open relay contacts 108 serve to prevent a backfeed from L1 to the control circuit whenever door switch contacts 105B are closed.

Signal lights (indicated within dashed line 200 on FIG. 7) are provided to indicate the various states of the cycles of operation: one set of lights on the machine, and a duplicate set on the remote control panel. Blue lights 140A, 140B, indicating that there is power on the control circuit, are energized when both switch 102 (remote control panel) and switch 103A (machine) are closed. Green lights 141A, 141B, indicating that the machine is operating in its automatic control cycle, are energized by the holding circuit, line 115. Red lights 142A, 142B, indicating the end of the automatic cycle of operation, are energized through the normally-closed contacts 143 of holding relay 111 when it drops out at the end of the automatic cycle, these lights remaining energized until contacts 143 open when relay 111 is energized upon the initiation of a new automatic cycle.

Other embodiments are within the following claims.

We claim:

1. A solvent reclaiming dryer, comprising:

an endless duct system for transporting a stream of air laden with solvent vapors, said duct system including in its circuit an evaporating chamber, a fan, a heater, and a condenser, a condenser bypass duct, a first damper movable between a bypass position in which the entrance to said condenser is closed and said bypass is open and a condensing position in which the entrance to said condenser is open and said bypass is closed, means for pre-heating the air in said endless duct system by moving said first damper to said bypass position to thereby accelerate heating of said air, and means for thereafter reclaiming said solvent, said reclaiming means including electrical control means for periodically cycling said first damper from said bypass position to said condensing position, said control means being operative to move said damper to said bypass position for a bypass time interval long enough to resaturate said air with solvent vapors, and said control means being operative to move said damper from said bypass condition to said condensing position for a condensing time interval long enough to condense some but not all of the solvent being carried by said air, whereby said condenser is continually supplied with air saturated or nearly saturated with solvent vapors, thereby increasing the speed at which condensate is reclaimed.

2. The apparatus of claim 1 further comprising a heater bypass branch duct which can be opened or closed by a second damper which blocks air flow to the heater when positioned to open said bypass branch duct, said second damper being responsive to a temperature sensing control to close said heater bypass duct when a sensed temperature within said casing is below a predetermined level and to open said heater bypass duct when said sensed temperature is above said predetermined level, and said bypass time interval is short enough to avoid increasing the temperature within said casing above said predetermined level during said bypass time interval.

3. The apparatus of claim 2 wherein said condensing time interval lasts more than 15 seconds and said bypass time interval lasts less than 60 seconds.

4. The apparatus of claim 3 wherein said condensing time interval lasts 55 to 65 seconds and said bypass time interval lasts 20 to 30 seconds.

5. The apparatus of claim 3 or 4 wherein said control means includes means to continue cycling said first damper between said positions for a period lasting between 20 and 40 minutes.

6. The apparatus of claim 1 further comprising an on-off time delay relay and a damper mover for actuating said first damper operably connected to said on-off relay to be alternately activated and deactivated.

7. The apparatus of claim 6 wherein said damper mover includes a solenoid operated fluid valve and a fluid cylinder connected to said valve, said fluid cylinder having a plunger that is attached to said first damper, and said solenoid valve being operably connected to said on-off relay.

8. The apparatus of claim 7 wherein said plunger is arranged to drive said damper to a first position when said solenoid valve is open, and further comprising a spring for returning said damper to a second position when said solenoid valve is closed.

9. The apparatus of claim 8 wherein said fluid is air.

10. The apparatus of claim 1 further comprising
a casing enclosing said endless duct system,
a safety opening passing through said casing, and
a cover normally providing a vaportight closure for said opening during operation of said apparatus, said cover responsive to increased pressures caused by an explosion within said casing to allow release thereof.

11. The apparatus of claim 10 wherein said cover is pivotally mounted and biased into its closed position by gravity both before and after an explosion.

12. The apparatus fo claim 10 wherein said cover is mounted upon a shaft within a sleeve attached to said casing for limited movement along an axis perpendicular to said opening, said cover being biased into its closed position by gravity both before and after an explosion.

13. The apparatus of claim 1 further comprising
a casing enclosing said endless duct system,
a sensor associated with said casing,
a conduit connected to said casing,
a reservoir of fire suppressing fluid connected to said conduit for delivery therethrough and into said casing of said first suppressing fluid, and
a valve associated with said conduit and responsive to said sensor to open upon the occurrence of predetermined fire related conditions.

14. The apparatus of claim 13 wherein said sensor is a fusible link being suspended within said casing and connected to a support element for a first weight attached to a first activating lever of said valve, said link made to melt upon being subjected to temperatures attained during a fire, and cause said first weight to activate said valve.

15. The apparatus of claim 14 further comprising
a hatch covering an opening in a casing enclosing said endless duct system, said hatch being mounted on a rotatable shaft and rotating open in response to an explosion within said casing, and
a hook being attached to said shaft and supporting a second weight attached to a second activating lever of said valve, said weight becoming unsupported upon opening of said hatch in response to an explosion and activating said valve.

16. A fabric drying and solvent reclaimer apparatus comprising
a casing enclosed endless duct system including an evaporating chamber, fan, heater and condenser in its circuit so that a stream of heated solvent-laden air may be driven from said chamber to said condenser,
a sensor associated with said casing,
a conduit connected to said casing,
a reservoir of fire suppressing fluid connected to said conduit for delivery therethrough and into said casing of said first suppressing fluid, and
a valve associated with said conduit and responsive to said sensor to open upon the occurrence of predetermined fire related conditions, and
wherein said sensor is a fusible link being suspended within said casing and connected to a support element for a first casing and connected to a support element for a first weight attached to a first activating lever of said valve, said link made to melt upon being subjected to temperatures attained during a fire, and cause said first weight to activate said valve, and
further comprising a hatch covering an opening in a casing enclosing said endless duct system, said hatch being mounted on a rotatable shaft and rotating open in response to an explosion within said casing, and
a hook being attached to said shaft and supporting a second weight attached to second activating lever of said valve, said weight becoming unsupported upon opening of said hatch in response to an explosion and activating said valve.

* * * * *